US006687669B1

(12) United States Patent
Schrögmeier et al.

(10) Patent No.: US 6,687,669 B1
(45) Date of Patent: Feb. 3, 2004

(54) METHOD OF REDUCING VOICE SIGNAL INTERFERENCE

(76) Inventors: Peter Schrögmeier, Hochstrasse 9, D-88131 Lindau (DE); Tim Haulick, Nelly-Sachs-Strasse 75, D-89131 Blaustein (DE); Klaus Linhard, Gundershofen 86, D-89603 Schelklingen (DE)

( * ) Notice: Subject to any disclaimer, the term of this patent is extended or adjusted under 35 U.S.C. 154(b) by 0 days.

(21) Appl. No.: 09/214,910

(22) PCT Filed: Jul. 2, 1997

(86) PCT No.: PCT/EP97/03482

§ 371 (c)(1),
(2), (4) Date: Nov. 3, 1999

(87) PCT Pub. No.: WO98/03965

PCT Pub. Date: Jan. 29, 1998

(30) Foreign Application Priority Data

Jul. 19, 1996 (DE) ..... 196 29 132

(51) Int. Cl.[7] ..... G10L 21/02; G10L 19/00
(52) U.S. Cl. ..... 704/226; 704/200.1
(58) Field of Search ..... 704/226, 200.1, 704/200

(56) References Cited

U.S. PATENT DOCUMENTS

| | | | | |
|---|---|---|---|---|
| 4,972,484 A | | 11/1990 | Theile et al. | |
| 5,400,409 A | * | 3/1995 | Linhard | 381/92 |
| 5,550,924 A | * | 8/1996 | Helf et al. | 381/94.3 |
| 5,742,927 A | * | 4/1998 | Crozier et al. | 704/226 |

FOREIGN PATENT DOCUMENTS

| | | |
|---|---|---|
| DE | 38 05 946 A1 | 9/1989 |
| EP | 0 615 226 A2 | 9/1994 |
| EP | 06 61 821 A1 | 7/1995 |
| EP | 0 669 606 A2 | 8/1995 |
| WO | 95/ 16259 A1 | 6/1995 |

OTHER PUBLICATIONS

Azirani et al, "Optimizing Speech Enhancement by Exploiting Masking Properties", 1995, ICASSP–95, International Conference on Acoustics, Speech, and Signal Processing, vol. 1, pp. 800–803.*

Azirani et al, "Optimizing Speech Enhancement by Exploiting Masking Properties", 1995, ICASSP–95, International Conference on Acoustics, Speech, and Signal Processing, vol. 1, pp. 800–803.*

Tracy L. Petersen and Steven F. Boll, Acoustic Noise Suppression in the Context of a Perceptual Model.

Hugo Fastl, Psychoakustik und Geräuschbeurteilung.

Steven F. Boll, Suppression of Acoustic Noise in Speech Using Spectral Subtraction.

M. Berouti, R. Schwartz and J. Makhoul, Enhancement of Speech Corrupted by Acoustic Noise.

James D. Johnston, Transform Coding of Audio Signals Using Perceptual Noise Criteria.

Nathalie Virag, Speech Enhancement Based on Masking Properties of the Auditory System.

T. Tsoukalas, M. Paraskevas and J. Mourjopoulos, Speech Enhancement Using Psychoacoustic Criteria.

* cited by examiner

*Primary Examiner*—Richemond Dorvil
*Assistant Examiner*—Angela Armstrong
(74) *Attorney, Agent, or Firm*—Davidson, Davidson & Kappel, LLC

(57) ABSTRACT

In a method for reducing interferences in a voice signal, a noise reduction method is applied to the voice signal, and spectral psychoacoustic masking is taken into account. A spectral masking curve is determined both for the input signal and the output signal of the noise reduction method. By comparing the signal portions exceeding the respective masking curve, newly-audible portions are detected in the form of interference in the output signal and subsequently damped selectively.

9 Claims, 5 Drawing Sheets

METHOD OF REDUCING VOICE SIGNAL INTERFERENCE

BACKGROUND

The invention concerns a method for reducing voice signal interference.

Such a method can have an advantageous application for eliminating interference in voice signals for voice communication, in particular hands-off communication systems, e.g. in motor vehicles, voice detection systems and the like.

A frequently used method for reducing the noise portion in voice signals with interference is the so-called spectral subtraction. This method has the advantage of a simple implementation without much expenditure and a clear reduction in noise.

One uncomfortable side effect of the noise reduction by means of spectral subtraction is the occurrence of tonal noise portions that can be heard briefly and which are referred to as "musical tones" or "musical noise" because of the auditory impression.

Measures for suppressing "musical tones" through spetral subtraction include the overestimation of the interference output, that is to say the overcompensation of the interference, having the disadvantage of increased voice distortion or allowing for a relatively high noise base with the disadvantage of only a slight noise reduction (e.g. "Enhancement of Speech Corrupted by Acoustic Noise" by Berouti, M.; Schwartz, R.; Makhoul, J.; in Proceedings on ICASSP, pp. 208–211, 1979). Methods for a linear or non-linear smoothing and thus suppression of the "musical tones" are described, for example, in "Suppression of Acoustic Noise in Speech Using Spectral Subtraction" by S. F. Boll in IEEE Vol. ASSP-27, No. 2, pp 113–120. An effective, non-linear smoothing method with median filtering is disclosed in the DE 44 05 723 A1.

Also known are methods, which in addition to the spectral subtraction take into account the psychoacoustic perception (e.g. T. Petersen and S. Boll, "Acoustic Noise Suppression in a Perceptual Model" in Proc. On ICASSP, pp. 1086–1088, 1981). The signals are transformed into the psychoacoustic loudness range in order to carry out a more aurally correct processing. In "Speech Enhancement Using Psychoacoustic Criteria," Proc. On ICASSP, pp. II359–II362, 1993, and G. Virag in "Speech Enhancement Based on Masking Properties of the Auditory System," Proc. On ICASSP, pp. 796–799, 1995, D. Tsoukalis, P. Paraskevas and M. Mourjopoulos use the calculated covering curve to find out which spectral lines are masked by the useful signal and thus do not have to be damped. This improves the quality of the voice signal. However, the interfering "musical tones" are not reduced in this way.

SUMMARY OF THE INVENTION

It is an object of the present invention to provide an improved a method for reducing interference in voice signals.

The invention provides a method for reducing interferences in a voice signal. The method includes:

- applying a noise reduction method to the voice signal;
- taking into account spectral psychoacoustic masking;
- determining a first spectral masking curve for an input signal of the noise reduction method;
- determining a second spectral masking curve for an output signal of the noise reduction method; and
- selectively damping newly audible portions of the output signal which are not opposed by spectrally corresponding portions of the input signal that exceed the first spectral masking curve.

The invention is based on the fact that the signal portions, which cannot be heard separately until the noise reduction, are detected as interferences and are subsequently reduced or removed through a selective damping. The exceeding of a masking curve (masking threshold) is in this case used as criterion for audibility, in a manner known per se.

The determination of masking curves is known, e.g. from sections of the initially mentioned state of the technology and more specifically also from Tone Engineering, Chapter 2, Psychoacoustics and Noise Analysis (pp. 10–33), Expert Publishing, 1994. The masking curves can be determined on the basis of the actual voice signals as well as on the basis of a noise signal during speech pauses, wherein various psychoacoustic effects can also be taken into account. The masking curves, which are also referred to as concealing curves, masking thresholds, monitoring thresholds and the like in the relevant literature, can be viewed as frequency-dependent level threshold for the audibility of a narrow-band tone.

In addition to using them for interference elimination, such masking curves are also used, for example, for data reduction during the coding of audio signals. Details concerning steps that can be taken for determining a masking curve follow, for example, from "Transform Coding of Audio Signals Using Perceptual Noise Criteria", by J. Johnston in IEEE Journal on Select Areas Commun., Volume 6, pp. 314–323, February 1988, in addition to the previously mentioned publications. Basic steps of a typical method for determining a masking curve from the short-term spectrum of a voice signal with interference are, in particular:

- A critical band analysis, where a signal spectrum is divided into so-called critical bands and where a critical band spectrum B(n) (also bark spectrum with n as band index) is obtained from the performance spectrum P(i) through summing up within the critical bands;
- Convolution of the bark spectrum with a spreading function for taking into account the masking effects over several critical bands, which makes it possible to obtain a modified bark spectrum;
- Possible, additional consideration of the varied masking properties of noise-type and tone-type portions by an offset factor that is determined through the composition of the signal;
- A bark-related masking curve T(n) is obtained, following re-scaling in proportion to the respective energy in the critical bands and, if necessary, raising of the lower values to the values of the auditory threshold in the rest position, and a frequency-specific masking curve V(i) with V(i)=T(n) follows from this for all frequencies i within the respective, critical band n.

With the determined masking curve V(i), the spectral portions of the signal can be divided into audible ($P(i)>V(i)$) and masked ($P(i)\leqq V(i)$) portions by comparing the performance spectrum P(i) to the masking curve V(i).

BRIEF DESCRIPTION OF THE DRAWINGS

In the following, the invention is explained in further detail based on exemplary embodiments and by referring to the illustrations, wherein.

DETAILED DESCRIPTION

Figure 1:
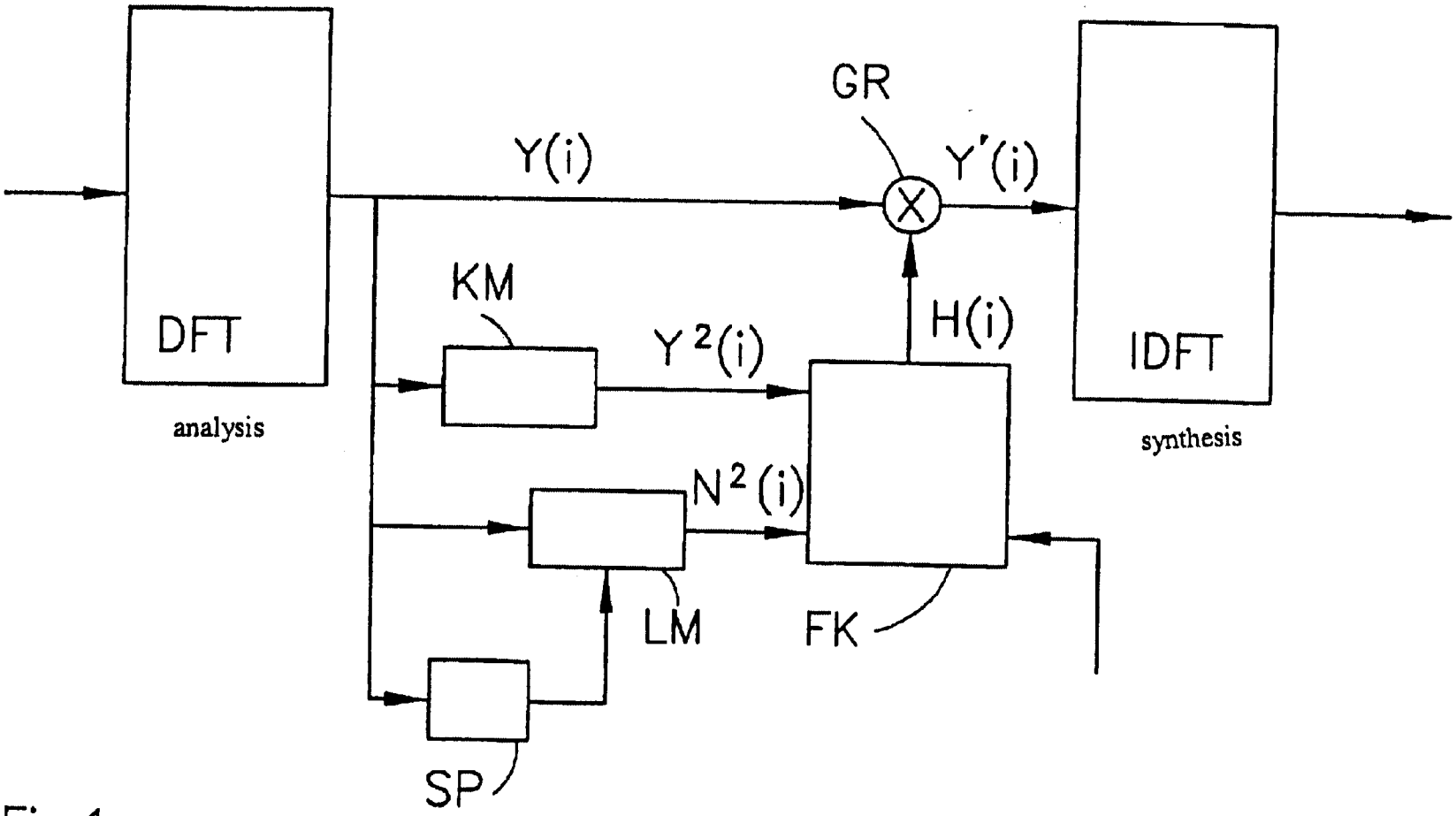
PRIOR ART Fig. 1
FIG. 1 Shows a block diagram of a prior art standard method for spectral subtraction.

The methods for spectral subtraction are based on the processing of the short-time rate spectrum of the input signal with interference. During speech pauses, the interference output spectrum is estimated and subsequently subtracted with uniform phase from the input signal with interference. This subtraction normally occurs through a filtering. As a result of this filtering, the spectral portions with interference are weighted with a real factor, in dependence on the estimated signal-to-noise ratio of the respective spectral band. The noise reduction consequently results from the fact that the spectral ranges of the useful signal, which experience interference, are damped proportional to their interference component. A simplified block diagram in FIG. 1 shows a typical prior art realization of the spectral subtraction algorithm. The voice signal with interference is separated in an analysis stage, e.g. through a discrete Fourier Transformation (DFT) into a series of short-term spectra Y(i). From the Fourier coefficient, the unit KM forms a short-term mean value, which represents an estimated value for the mean performance $Y^2(i)$, with i as the discrete frequency index of the input signal with interference. Controlled by the speech pause detector SP, the estimation of a mean interference output spectrum $N^2(i)$ in the voice-signal free segments occurs in a unit LM. Each spectral line Y(i) of the input signal is subsequently multiplied with a real filter coefficient H(i), which is computed from the short-term mean value $Y^2(i)$ and the mean value for the interference output $N^2(i)$ in the unit FK. The processing step for noise reduction is shown in the drawing as multiplication stage GR. The noise-reduced voice signal results at the output of the synthesis stage as a result of an inverse discrete Fourier Transformation (IDFT).

The calculation of the filtering coefficient H(i) can occur based on varied weighting rules that are known per se. The coefficient is normally estimated based on $$H(i)=\max\{(1-{}_{13}N^2(i)/Y^2(i)), f1\}$$

with f1 (also spectral floor) as specifiable basic value that represents a lower barrier for the filter coefficient and normally amounts to $0.1<f1<0.25$. It determines a residual noise component that remains in the output signal of the spectral subtraction and which limits the lowering of the monitoring threshold, thus covering small-band portions in the noise-reduced output signal of the spectral reduction. Observing a basic value f1 improves the subjective auditory impression.

In order to mask all residual interferences of the type "musical tones," a basic value of approximately 0.5 would have to be selected, which would reduce the maximum achievable noise reduction to approximately 6 dB.

A characteristic feature of musical tones, used with the method according to the invention, is that they can be detected as interference by the human ear only in the output signal of the noise-reduction method. The audibility can be detected quantitatively with a second masking curve for this output signal. In contrast to the useful voice portions in the output signal, which also exceed the threshold level of the second masking curve and are also audible in the input signal as exceeding the level of the first masking curve, the musical tones can be distinguished as new, audible portions by comparing the audible signal portions in the output signal and the input signal for the noise reduction and can be damped selectively in a subsequent processing step.

Figure 2:
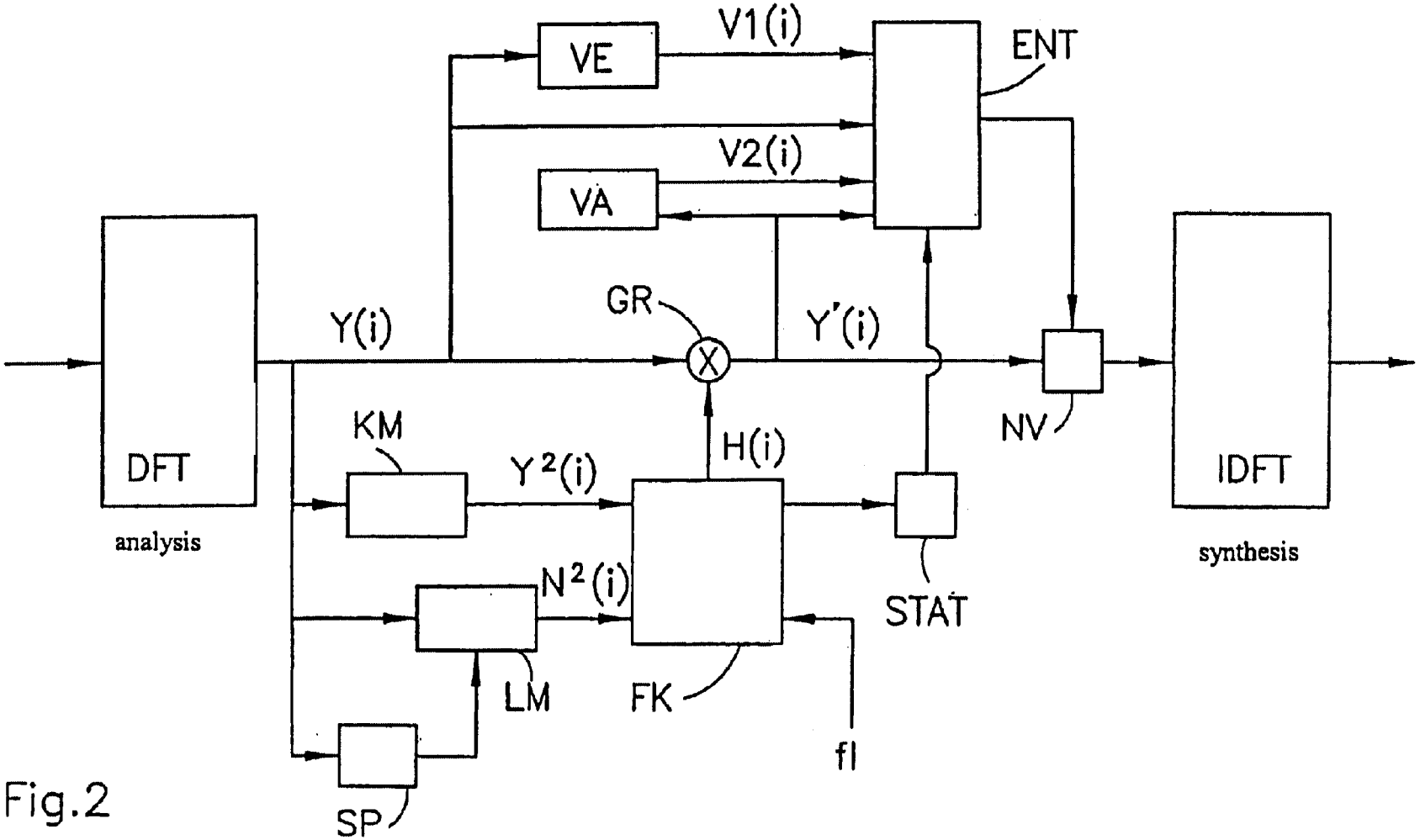
FIG. 2 Shows a block diagram for a method according to the invention.

The method according to the invention for detecting and suppressing small-band interferences such as musical tones is explained with the aid of the block diagram in FIG. 2. It represents a broadening of the standard method for spectral subtraction, shown in FIG. 1. Insofar as the sketched method in FIG. 2 coincides with the sketched, known method in FIG. 1, the same reference numbers are used. A first masking curve V1(i) is determined in a unit VE from the input signals Y(i) of the noise reduction GR. A second masking curve V2(i) is determined in the VA from the output signals Y' (i) of the noise reduction.

Alternatively, the first masking curve V1(i) can also be determined from the mean interference output spectrum at the noise-reduction input during the speech pauses. The second masking curve can also be derived from the first masking curve, e.g. through a multiplication with the basic value f1, V2(i)=f1·V1(i).

Determining the masking curves from the momentary input signals and output signals of the noise-reduction in particular has the advantage that non-stationary noise portions as well as the masking effect of the voice portions are also taken into account. If, on the other hand, the first masking curve is determined from the mean interference output spectrum and the second masking curve is determined in an approximation based on V2(i)=f1·V1(i), this results in a considerable reduction in the calculation expenditure. The calculation expenditure can be reduced further in that the masking curve must be updated considerably less frequently, because the mean interference output spectrum as a rule changes only slowly with respect to time. The qualitatively improved, synthesized voice signal, however, is achieved with the determination of the masking curves from the Y(i) and Y'(i).

One embodiment of the invention provides for an additional improvement through the detection of stationary signal portions, which are excluded from the selective damping, even if they meet the criterion of being audible only in the output signal Y'(i). A detector STAT for detecting the stationary condition is therefore shown in FIG. 2.

It can be realized in different ways, eg. by following individual spectral lines or even filtering coefficents over a time period. A simple way to realize this follows from the requirement that several successively following filtering coefficients must respectively exceed a specific threshold value $thr_{stat}$, so that the following applies:

$$H_{k-n}(i), \ldots, H_{k-1}(i), H_k(i)>thr_{stat},$$

for example with n=2 and $thr_{stat}=0.35$.

In the decider ENT, audible tonal portions are initially detected in the output signal of the noise-reduction system with the aid of the second masking curve V2(i). If this does not concern a stationary component, then it is investigated whether the spectral component could be heard even before the filtering operation (noise reduction). This is done by using the first masking curve V1(i). If it is determined that the frequency component of the input signal Y(i) is masked, the spectral component in the output signal is assumed to be a musical tone and is damped in a subsequent processing stage NV. In the other case, meaning if there is no masking in the input signal, a determination is made for voice and no additional silencing occurs.

The additional silencing during the subsequent processing can occur in different ways. For example, the level value for a new, audible spectral component that is identified as interference can be set equal to the value of the second masking curve. Preferably, the detected level value of the interfering spectral component is set equal to a corrected value, which follows from the filtering of the spectrally corresponding input signal component with the basic value f1 as filtering coefficient.

Various stages of the signal processing of a voice signal with interference according to the inventive method are sketched in FIG. 3.

Figure 3A:
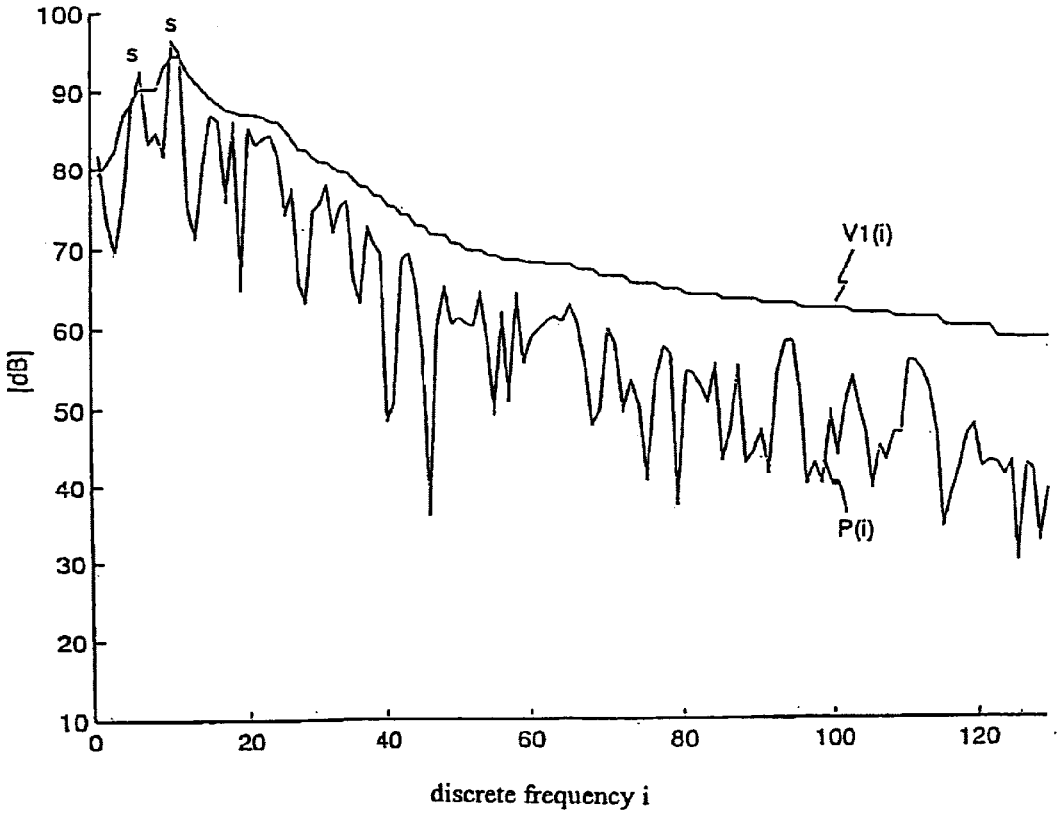
FIG. 3 Shows a voice signal in various stages of the signal processing method according to the invention.
Figure 3B:
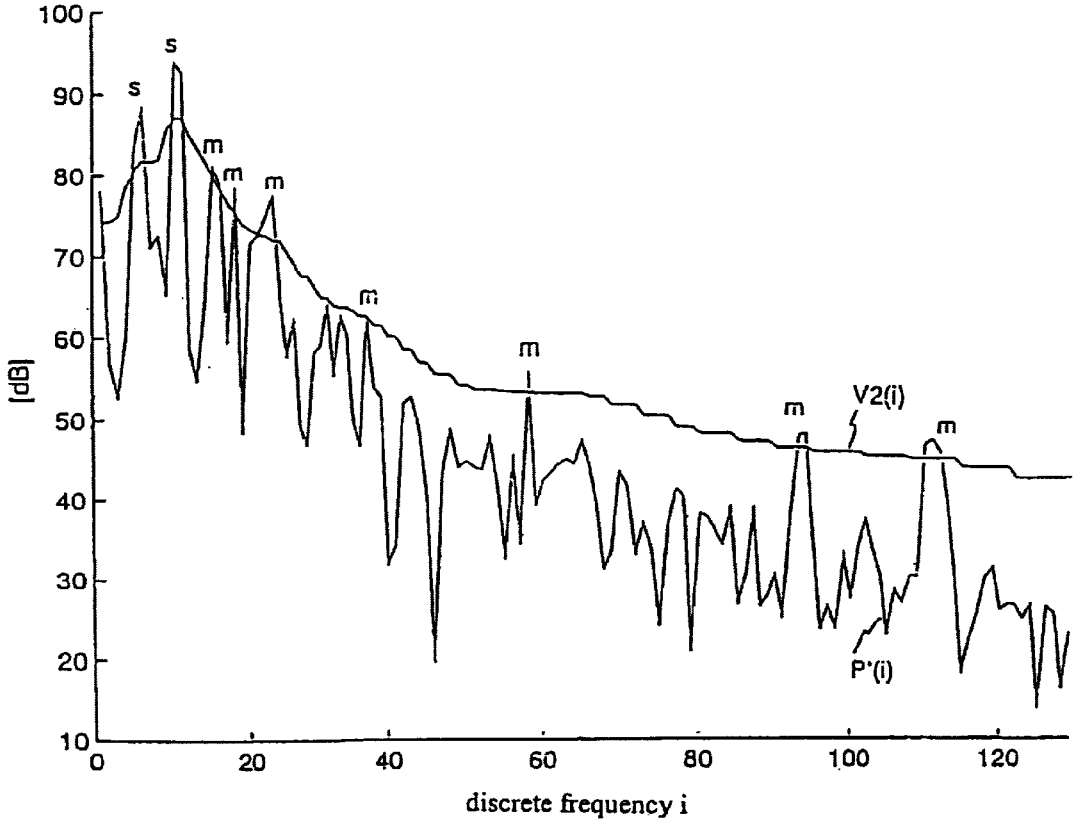
Figure 3C:
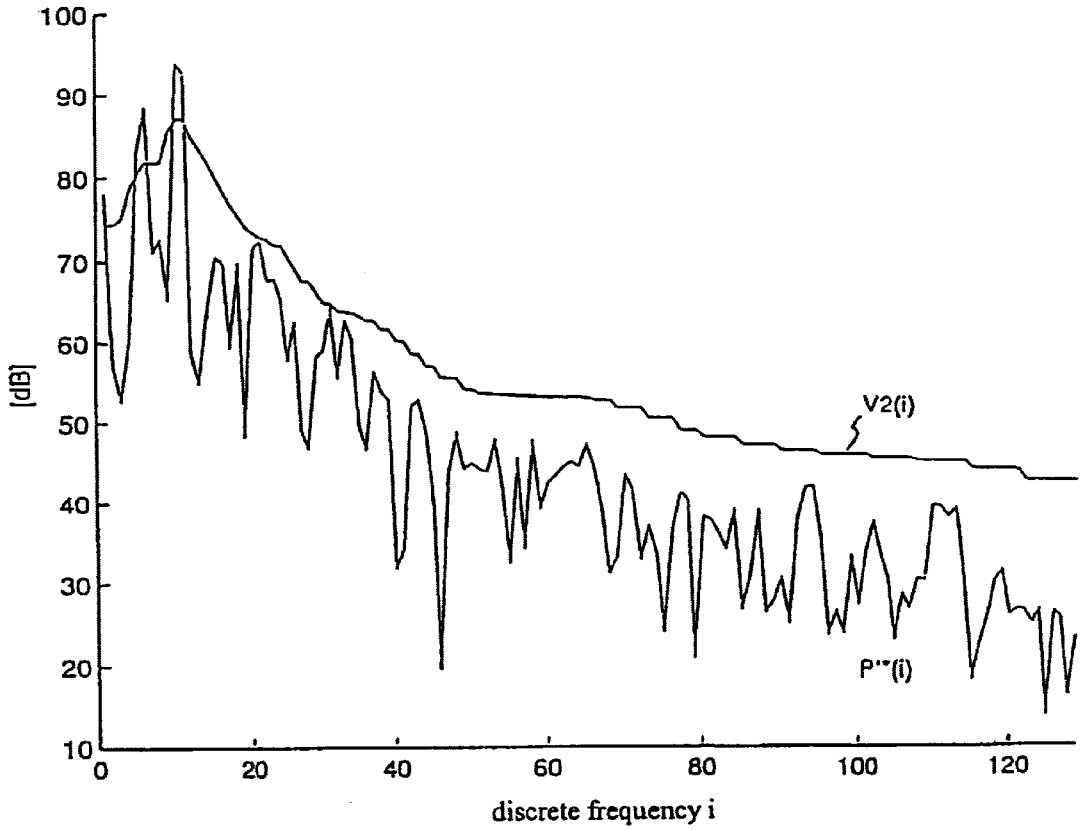

FIG. 3A shows a performance spectrum P(i) of a signal with interference at the input of the noise reduction, as well as a first masking curve V1(i), determined from this, with the signal portions s that exceed the masking curve. Following completion of the spectral subtraction, this results in a noise-reduced performance spectrum $P'(i)=Y'^2(i)$ with a thereof determined second masking curve V2(i) in which besides the signal portions s that exceed the masking curve V1(i) in FIG. 3A, additional signal portions m that exceed the second masking curve occur, which appear as non-masked and thus newly audible signal portions of the musical tones type. These newly audible signal portions can be detected and suppressed with the aid of a selective damping without detracting from the voice portions s. The performance spectrum P"(i), resulting form the selective damping, is sketched in FIG. 3C. It is only the signal portions s, assessed as voice signals, which exceed the masking curve, wherein these signals now exceed the masking curve V2(i) by a much higher degree than the corresponding portions in the input signal exceed the therein valid masking curve V1(i) (FIG. 3A) and are thus clearly audible. The level of the musical tones m in FIG. 3B is pushed below the masking curve V2(i) and these are consequently no longer audible as individual tones.

The invention is not limited to the spectral subtraction for noise reduction. The method for determining the masking curves at the input and the output of a noise reduction and to detect and suppress interferences at the output as a result of newly audible portions can be transferred to other signal processing systems, e.g. for the signal coding.

What is claimed is:

1. A method for reducing interferences in a voice signal, the method comprising:

applying a noise reduction method to the voice signal;

taking into account spectral psychoacoustic masking;

determining a first spectral masking curve for an input signal of the noise reduction method;

determining a second spectral masking curve for an output signal of the noise reduction method;

identifying newly audible portions of the output signal by comparing signal portions of the output signal which exceed the second spectral masking curve with signal portions of the input signal that exceed the first spectral masking curve; and selectively damping the identified newly audible portions of the output signal.

2. The method as recited in claim 1 wherein the noise reduction method includes a spectral subtraction method.

3. The method as recited in claim 2 wherein the selective damping is performed by reducing each of the newly audible portions to its respective fundamental value of the spectral subtraction.

4. The method as recited in claim 1 wherein the selective damping is performed by reducing each of the newly audible portions to its respective fundamental value for the second spectral masking curve.

5. The method as recited in claim 1 wherein the selective damping is performed so that static portions of the newly audible portions are exempted from the selective damping for a time interval.

6. The method as recited in claim 1 wherein the determining the second spectral masking curve is performed using the output signal of the noise reduction method.

7. The method as recited in claim 1 wherein the determining the second spectral masking curve is performed using the first spectral masking curve.

8. The method as recited in claim 1 wherein the determining the first spectral masking curve is performed using the input signal of the noise reduction method.

9. The method as recited in claim 1 wherein the determining the first spectral masking curve is performed using noise signals during speech pauses.

* * * * *